US005241150A

United States Patent [19]

Garvey et al.

[11] Patent Number: 5,241,150

[45] Date of Patent: Aug. 31, 1993

[54] MICROWAVE FOOD PACKAGE

[75] Inventors: Joseph F. Garvey, St. Paul, Minn.; Curtis L. Larson, Hudson, Wis.; Pierre H. LePere, Cottage Grove, Minn.

[73] Assignee: Minnesota Mining and Manufacturing Company, St. Paul, Minn.

[21] Appl. No.: 908,648

[22] Filed: Jul. 2, 1992

Related U.S. Application Data

[63] Continuation of Ser. No. 415,999, Oct. 2, 1989, abandoned.

[51] Int. Cl.[5] ..... H01B 6/80

[52] U.S. Cl. ..... 219/10.55 E; 426/234; 426/109; 426/115; 426/241; 99/DIG. 14; 229/903; 219/10.55 F

[58] Field of Search ..... 219/10.55 E, 10.55 F; 426/107, 109, 110, 113, 114, 115, 118, 234, 241, 243; 206/219, 222; 99/DIG. 14; 229/903, 905, 906

[56] References Cited

U.S. PATENT DOCUMENTS

| | | | |
|---|---|---|---|
| 1,332,984 | 11/1919 | Wesley . | |
| 2,103,389 | 12/1937 | Salfisberg | 221/60 |
| 2,401,109 | 5/1946 | Rohdin | 93/35 |
| 2,714,070 | 7/1955 | Welch | 9/221 |
| 2,718,105 | 9/1955 | Ferguson et al. | 53/5 |
| 2,756,154 | 7/1956 | Mahaffy | 99/171 |
| 2,865,768 | 12/1958 | Barnes et al. | 99/171 |
| 3,052,554 | 9/1962 | Colman | 99/171 |
| 3,171,581 | 3/1965 | Kugler | 229/53 |
| 3,194,185 | 7/1965 | Spinosa | 107/54 |
| 3,198,228 | 8/1965 | Naito | 150/3 |
| 3,278,085 | 10/1966 | Brown | 222/107 |
| 3,380,646 | 4/1968 | Doyen et al. | 229/57 |
| 3,404,988 | 10/1968 | Rausing | 99/171 |
| 3,418,059 | 12/1969 | Robe | 401/206 |
| 3,438,567 | 4/1969 | Bell, Jr. | 229/57 |
| 3,502,487 | 3/1970 | Byrd | 99/171 |
| 3,582,363 | 6/1971 | Jones | 99/171 |
| 3,595,468 | 7/1971 | Repke | 229/66 |
| 3,601,252 | 8/1971 | Sager | 206/56 AA |
| 3,663,239 | 5/1972 | Rowe et al. | 99/171 |
| 3,689,291 | 9/1972 | Draper | 99/177 |
| 3,741,778 | 6/1973 | Rowe | 99/171 H |
| 3,775,239 | 11/1973 | Snow | 161/250 |
| 3,799,914 | 3/1974 | Schmit et al. | 426/85 |
| 3,865,301 | 2/1975 | Pothier et al. | 229/14 H |
| 3,873,735 | 3/1975 | Chalin et al. | 426/87 |
| 3,973,045 | 8/1976 | Brandberg et al. | 426/110 |
| 3,980,225 | 9/1976 | Kan | 229/57 |
| 3,986,640 | 10/1976 | Redmond | 222/92 |
| 3,997,677 | 12/1976 | Hirsch et al. | 426/113 |

(List continued on next page.)

FOREIGN PATENT DOCUMENTS

| | | | |
|---|---|---|---|
| 672445 | 10/1963 | Canada | 220/2 |
| 0038114A1 | 2/1981 | European Pat. Off. . | |
| 0109737A3 | 9/1983 | European Pat. Off. . | |
| 0174188A3 | 9/1985 | European Pat. Off. . | |
| 2451182 | 3/1980 | France . | |

OTHER PUBLICATIONS

European Search Report, Application Number EP 90 31 0735 Dec. 30, 1991, 3 pages.

Article entitled "Food Packaging," p. 260 of the May 1989 issue of *Prepared Foods* (one page).

Advertisement entitled "One Hand, One Motion Readily Dispenses All Product Contained," from *Koch Packaging Systems*, undated (one page).

Advertisement for "Ziploc® Microfreez Bags," (one page).

*Primary Examiner*—Philip H. Leung

*Attorney, Agent, or Firm*—Gary L. Griswold; Walter N. Kirn; Mark W. Binder

[57] ABSTRACT

A microwave food package having a chamber for receipt of a foodstuff. An orifice is formed in the package for dispensing the foodstuff in a flowable state after heating in a microwave oven. The package is insulated to permit handling of the package immediately after heating of the foodstuff.

20 Claims, 7 Drawing Sheets

U.S. PATENT DOCUMENTS

| | | | |
|---|---|---|---|
| 4,013,798 | 3/1977 | Goltsos | 426/107 |
| 4,038,425 | 7/1977 | Brandberg et al. | 426/108 |
| 4,041,851 | 8/1977 | Jentsch | 93/35 SB |
| 4,121,510 | 10/1978 | Frederick | 99/425 |
| 4,143,165 | 3/1979 | Daswick | 426/113 |
| 4,216,639 | 8/1980 | Gautier | 53/413 |
| 4,252,238 | 2/1981 | Spiegelberg et al. | 206/210 |
| 4,260,060 | 4/1981 | Faller | 206/622 |
| 4,292,332 | 9/1981 | McHam | 426/111 |
| 4,358,466 | 11/1982 | Stevenson | 426/106 |
| 4,361,235 | 11/1982 | Gautier | 206/527 |
| 4,369,885 | 1/1983 | Redmond | 206/484 |
| 4,378,069 | 3/1983 | Franco | 426/115 |
| 4,404,241 | 9/1983 | Mueller et al. | 426/113 |
| 4,419,373 | 12/1983 | Oppermann | 426/234 |
| 4,478,858 | 10/1984 | Baird et al. | 426/126 |
| 4,493,574 | 1/1985 | Redmond | 401/132 |
| 4,553,010 | 11/1985 | Bohrer et al. | 219/10.55 E |
| 4,611,715 | 9/1986 | Redmond | 206/484 |
| 4,640,838 | 2/1987 | Isakson et al. | 426/107 |
| 4,700,532 | 10/1987 | Redmond | 53/452 |
| 4,703,148 | 10/1987 | Mikulski et al. | 219/10.55 F |
| 4,703,149 | 10/1987 | Sugisawa et al. | 219/10.55 E |
| 4,720,014 | 1/1988 | Redmond | 206/525 |
| 4,724,982 | 2/1988 | Redmond | 222/94 |
| 4,782,953 | 11/1988 | McPhee | 206/557 |
| 4,795,271 | 1/1989 | Lane, Jr. et al. | 383/104 |
| 4,810,844 | 3/1989 | Anderson | 219/10.55 E |
| 4,810,845 | 3/1989 | Seaborne | 219/10.55 E |
| 4,818,545 | 4/1989 | Kunimoto | 426/107 |
| 4,819,406 | 4/1989 | Redmond | 53/51 |
| 4,890,439 | 1/1990 | Smart | 53/410 |
| 4,937,410 | 6/1990 | Anderson | 219/10.55 E |
| 4,973,810 | 11/1990 | Brauner | 219/10.55 E |
| 4,992,636 | 2/1991 | Namiki et al. | 219/10.55 E |

MICROWAVE FOOD PACKAGE

This is a continuation of application Ser. No. 07/415,999 filed Oct. 2, 1989, now abandoned.

TECHNICAL FIELD

The present invention relates to food packages for use in a microwave oven and in particular, it relates to food packages for foodstuffs that are to be dispensed from the package in a flowable state after heating in a microwave oven.

BACKGROUND ART

Numerous package designs and utensils have been devised for cooking various foodstuffs in microwave ovens. However, certain foodstuffs are difficult to heat uniformly in a microwave oven and dispense the foodstuff after heating in the microwave oven. This is particularly true for foodstuffs such as processed cheese that is to be melted and dispensed in a flowable state. Conventional microwave food packages for processed cheese include rigid cup like receptacles. In such designs the outer portions of the processed cheese contained in the cup like receptacle tend to heat faster than the interior portion. Thus, in order to reduce the cheese to a flowable (e.g. liquid) state, the outer portions of the cheese tend to burn and stick to the sides of the receptacle, while the interior portion "pools" at the bottom of the receptacle. This is inefficient and undesirable in terms of the energy and food wasted, and the reduced amount of melted cheese available after heating in the microwave oven. It is also difficult to easily and completely dispense all of the melted cheese from the receptacle without a utensil and thus more of the foodstuff tends to be wasted when utensils are not available.

Further, it would be tedious and time consuming to clean such a package and/or a utensil, if reuse were desired.

Another problem associated with some foodstuffs, such as processed cheese for use as a sauce, are the gasses, such as steam, that may be released from the foodstuff during heating in a microwave oven. If the package is open during cooking, the foodstuff may spill from the package, with evident undesirable results. Conversely, if the package is sealed during cooking to prevent the loss of the foodstuff, the gasses released during heating may create an undesirably high level of pressure within the package, again with potentially undesirable results if the package is unexpectedly breached.

Yet another problem associated with such food packages is that of handling the package and foodstuff after heating in a microwave oven, since the package tends to be too hot for direct manual contact. Further, the foodstuff not only heats rapidly, but also tends to cool and lose heat too rapidly for convenient dispensing after heating. If the foodstuff is not flowable in an unheated state, the too rapid cooling of the foodstuff may prevent dispensing of the foodstuff from the package.

DISCLOSURE OF INVENTION

According to the present invention there is provided a package for containing a quantity of a foodstuff for heating the foodstuff in a microwave oven and dispensing the foodstuff in a flowable state. The package includes a bag having a chamber for receiving the foodstuff, having opposed ends and an upper side and an opposing lower side adapted for generally horizontal placement of the foodstuff within the microwave oven. Means are provided for forming an orifice in the bag communicating with the chamber for dispensing the foodstuff in a flowable state after heating in the microwave oven. Means are provided for venting the chamber when the foodstuff is heated in the microwave oven to release vapor pressure within the chamber. Means are also provided for insulating at least part of the upper side of the bag to enable the bag to be handled after the foodstuff is heated in the microwave oven.

Further, the present invention provides for the above microwave food package in combination with a foodstuff.

BRIEF DESCRIPTION OF DRAWINGS

The present invention will be further described with reference to the accompanying drawing wherein like reference numerals refer to like parts in the several views, and wherein.

DETAILED DESCRIPTION

Figure 1:
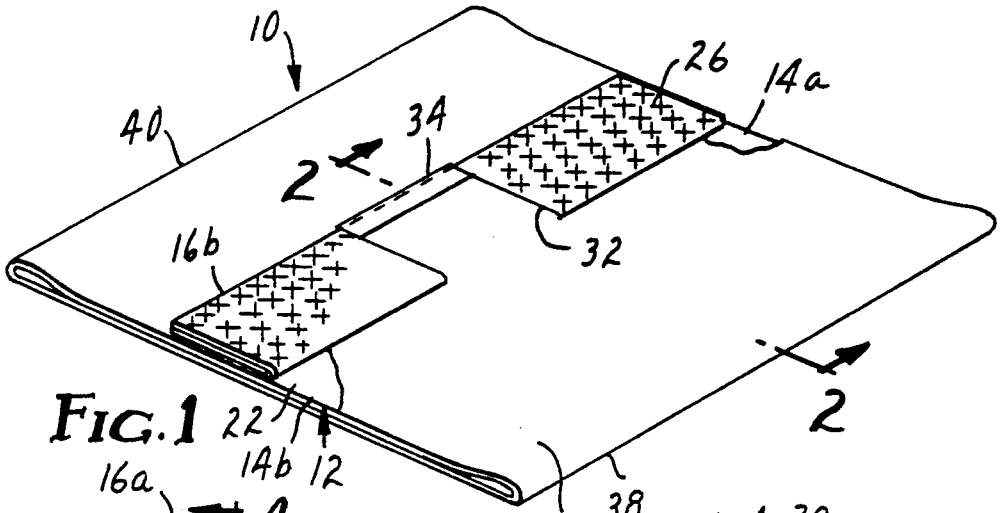
FIG. 1 is an isometric view of a microwave food package according to the present invention.
Figure 2:
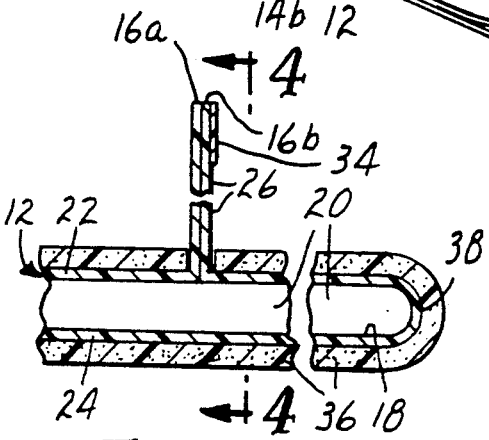
FIG. 2 is a magnified partial cross sectional view along plane 2—2 of the microwave food package of FIG. 1 containing a quantity of a foodstuff.
Figure 3:
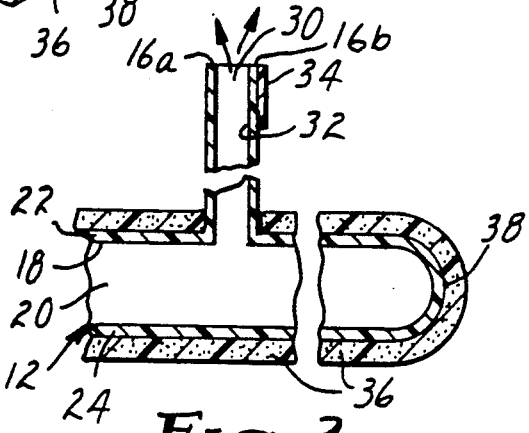
FIG. 3 is a magnified partial cross sectional view of the microwave food package of FIG. 2 after the foodstuff has been heated to a flowable state in a microwave oven and the venting member has been ruptured.
Figure 4:
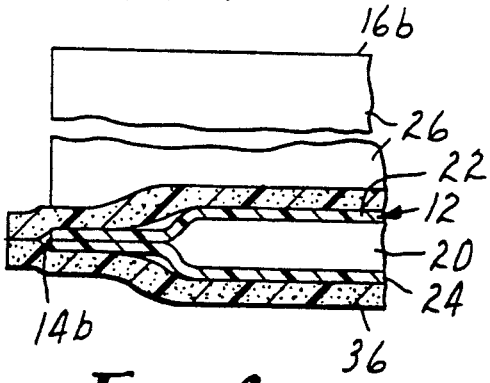
FIG. 4 is a magnified partial cross sectional view along plane 4—4 of the microwave food package of FIG. 2.
Figure 15A:
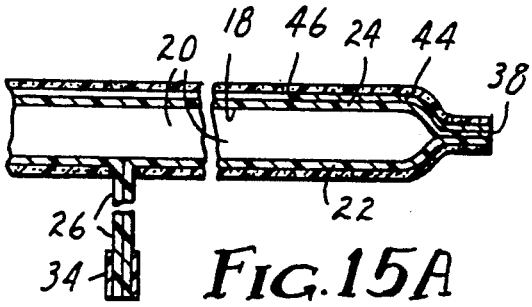
FIG. 15*a* is a partial cross sectional view of the microwave food package of FIG. 15.

Referring now to FIGS. 1–4, there is shown a microwave food package according to the present invention generally designated by the reference numeral 10.

Generally, the microwave food package 10 comprises a bag or pouch 12 constructed from flexible, microwave transparent polymeric material. Preferably, the material is such that bag 12 may be formed by folding the sheet over on itself and bonding aligned portions of facing surfaces adjacent side edges 14*a* and 14*b* and end edges 16*a* and 16*b* to form an enclosed chamber 18. The bonding may be accomplished such as by heat sealing the sheet material together or by use of a suitable adhesive, or by any other suitable means. Alternatively, bag 12 may be constructed in other arrangements, such as by sealing two or more separate sheets (not shown) together to form the chamber 18, or by sealing the ends of a tube like structure.

In the preferred embodiment of the invention, the bag is constructed from a polymeric film having two layers, an inner layer (not shown) that is heat sealable to itself, and an outer layer (not shown) that provides strength and support to the heat sealable layer and also acts as a moisture barrier to protect the foodstuff. The following is a non-limiting list of materials suitable for use in constructing the heat sealable layer: polypropylene, medium density polyethylene, ionomers, heat sealable polyesters, copolyesters, or blends of polyester and copolyester. The following is a non-limiting list of material suitable for use in constructing the support layer: polypropylene, polyester, and nylon.

In some applications, it may be desirable to incorporate an oxygen barrier layer (not shown) into the film to prolong the shelf life of the foodstuff when placed within the package, such as for "shelf stable" foodstuffs that don't require refrigeration. Preferably the oxygen barrier layer is located intermediate the heat sealable layer and the support layer, to protect the oxygen barrier layer from abrasion or other damage. Preferably, the oxygen barrier layer has an oxygen transmission rate of no greater than 15.5 cc per square meter per 24 hours at one (1) atmosphere and at room temperature. The oxygen barrier layer may be constructed of any suitable material such as polyvinylidene chloride (PVDC) or ethylene vinyl alcohol (EVOH).

The film may be constructed such as by co-extruding the layers, laminating the layers with a suitable adhesive or a combination of coextrusion and laminating.

The chamber 18 is generally uniform in thickness, broad, flat and relatively thin and is adapted for the receipt of foodstuff 20. The bag 12 includes an upper side 22 and an opposing lower side 24. Preferably, the side edges 14*a* and 14*b* are bonded adjacent the end edges 16*a* and 16*b* such that a flap 26 is formed in a generally medial position on the upper side 22 transverse to the side edges 14*a* and 14*b*.

The chamber 18 in the bag may be filled with any suitable foodstuff 20 that is desired to be heated in a microwave oven and dispensed through the orifice 30. By necessity, when the foodstuff 20 is dispensed through the orifice 30, it must be in a flowable state. For the purposes of this invention, the term "flowable" includes substances that are liquid, fluid or solid but having a consistency enabling the foodstuff to be poured or extruded through an orifice. The following is a non-limiting list of foodstuffs that may be used in the microwave food package of the present invention: processed cheese, ice cream toppings, hollandaise sauce, barbecue sauce, oriental hot sauces, hot breakfast cereal, syrup, pasta sauce, cream sauce, gravy, salad dressing, chili, butter, soups.

The bag includes means for forming an orifice in the microwave food package communicating with the chamber and exteriorly of the package for dispensing the foodstuff from the package after heating in a microwave oven. In the illustrated embodiment of the invention, the bag 12 includes preformed orifice 30 for dispensing the foodstuff after heating in a microwave oven. The orifice comprises a passageway 32 communicating with chamber 18 and extending through flap 26 exteriorly of the bag. Alternatively, the bag may be constructed with an orifice formed anywhere on the bag, in which case flap 26 of the bag may be omitted.

Alternatively, the bag may be constructed without a preformed orifice, but with means for forming an orifice in the bag during or after heating of the foodstuff.

Means are provided to enclose the preformed orifice 30 during heating of the foodstuff, to protect the foodstuff from contamination or degradation during storage and to prevent the foodstuff from escaping from the bag, and to enable the orifice to be opened for dispensing of the foodstuff, when desired. Preferably, the enclosing means provides a hermetic seal to prevent degradation of the foodstuff during storage. For instance, the end edges 16*a* and 16*b* of the bag 12 at the flap 26 may be sealed from side edge 14*a* to side edge 14*b*. The side edges of the bag may include aligned notches or the like (not shown) spaced from the end edges 16*a*, 16*b* to facilitate tearing of the film to open the orifice. Alternatively, a perforated or weakened line (not shown) may be formed in the flap 26 spaced from the end edges also to facilitate removal of the end edges of the flap and open the orifice, or a tape or like member (not shown) may be adhered to the exterior of the bag transversely across the neck portion, or a tear strip (not shown) may be adhered within the flap to assist in opening the orifice. Also, a piece of pressure sensitive adhesive tape (not shown) may be applied to the bag over the orifice, and then removed to dispense the foodstuff.

Means are also provided to automatically vent the chamber of the bag during the heating of the foodstuff to release vapor pressure that is created when the foodstuff exudes moisture and other gasses. The venting means will provide a controlled exhaustion of gases from the chamber 18 to prevent premature rupture of the chamber and the escape of the foodstuff.

While the package according to the present invention could be vented by puncturing, as with a fork, to allow the escape of steam and other vapors during cooking, preferably the package includes means that will automatically vent the package during heating of the foodstuff. That means for venting the bag could comprise pre-formed openings (such orifice 30) in the bag that are initially closed by a manually removable cover (e.g., a piece of pressure sensitive adhesive coated tape). Preferably, however, that means for venting comprises venting member 34 including a deposit of microwave susceptor material adhered at or in the vicinity of a heat sensitive material forming at least a portion of the bag so as to be in thermal communication with that portion of the bag, which microwave susceptor material will be heated by exposure to microwave radiation and will automatically cause a vent to form or open in or around the venting member during microwave heating of the foodstuff. The deposit of microwave susceptor material for 2,450 megahertz radiation normally used in household microwave ovens can comprise nonmetallic, microwave absorbing particles (e.g., graphite, carbon black, iron oxide or ferrite) dispersed in a nonmetallic (e.g., polymeric) binder, which deposit has a thickness within the range from 10 to 300 micrometers, with the particles comprising at least 10% by weight of the deposit as is taught in U.S. Pat. No. 4,640,838, entitled "Self-venting Vapor-tight Microwave Oven Package" issued Feb. 3, 1987 and incorporated herein by reference. Other configurations and/or materials may be employed, extending the range of thicknesses of the deposit to between 5 to 1000 micrometers, or even greater.

Preferably, however, the susceptor material is a metal vapor coating of aluminum with a surface resistance in the range of 50 to 300 ohms per square (about 100 ohms per square preferred) either coated directly on the bag or coated on a polymeric film adhered to the bag by a suitable adhesive. When the bag 12 comprises heat sensitive material such as thermoplastic film and the susceptor material comprises metal adhered by vapor deposition or susceptor particles adhered by adhesive directly to the film, heating of the deposit by microwaves can soften and weaken that portion of the film to which the deposit is adhered, thus causing that portion to rupture and vent the package under the influence of steam or vapor pressure within the bag. When an adhesive layer adheres the susceptor material to the heat sensitive material which is to be weakened by heat from the particles, that adhesive layer should be thin to afford good heat transfer, preferably from 10 to 20 micrometers.

When the susceptor material is adhered on a polymeric film adhered to the bag, rupturing of the softened and weakened portions of the bag 12 caused by heating of the deposit by microwaves can occur under the influence of steam or vapor pressure within the bag, or because one or both of the films shrink when they are heated causing tearing of the films under the deposit, or because of both causes.

When the susceptor material itself or a polymeric film to which it is adhered and the adhesive by which the film is adhered to a bag are impervious to vapors, but the susceptor material or adhesive will soften and weaken when heated; the susceptor material or film can be positioned over a weakness in the bag such as an opening, a slit, or a score. When so used, such a susceptor material may be covered with a vapor-impervious thermoplastic film. Upon doing so, heating of the susceptor material may either soften and weaken the covering thermoplastic film or film on which the susceptor material is coated, or venting may occur laterally through the susceptor material or through an unfilled adhesive layer by which the film and susceptor material are adhered over a weakness of the bag 12.

The susceptor material itself or a polymeric film to which the susceptor material is adhered can also be adhered along a seal between layers of material forming the bag 12 that is heat softenable so that heating of the layer during cooking of foodstuff within the package by microwave energy will cause the seal to rupture because of vapor pressure in the bag 12.

The susceptor material can form an alpha numeric message or a distinctive pattern that informs the user of the self-venting nature of the package. Whether directly placed on the bag 12 or cut from a pre-formed sheet that is adhered to the bag, the susceptor material may be shaped to concentrate the microwave energy. The susceptor material may have a distinctive shape to remind the user by its very appearance that the package is self venting and to position the package in the oven so that nothing spills when the vent forms. For such reasons, the susceptor material or other portions of the venting member may be highly conspicuous or indicia may be placed on the bag or package to direct attention of the user to the venting member. The susceptor material or the venting member may have the shape of a logo or trademark to identify the company marketing the package.

The microwave susceptor material may take the form of a rectangular piece of metal vapor coated film adhered by a suitable adhesive to the bag. The vapor coated film and top sheet of polymeric film forming the bag will be softened by heating of the metal vapor coating to cause rupturing of that top sheet of film and vapor coated film due to steam or vapor pressure within the bag during heating of the foodstuff by microwave energy so that the vent member will allow excess steam or vapor pressure within the bag to escape, while retaining sufficient steam or vapor within the bag to enhance heating of the foodstuff.

Preferably, and as shown in FIG. 1, a venting member 34 is located at or adjacent one side of the distal end of passageway 32 of orifice 30. This end is presealed after the foodstuff is placed within chamber 18. During heating in the microwave oven, the venting members 34 weaken the bond between facing sealed surfaces of the distal end of the passageway so that the orifice is opened, as illustrated hereinafter, a venting member 34 may be applied to both sides of flap 26, if desired.

Means are also provided to insulate the package, to enable handling of the bag and its contents immediately after heating in a microwave oven, and also to enhance the heat retention ability of the package after the foodstuff has been heated, and until the foodstuff is dispensed. In the illustrated embodiment, the insulation means takes the form of a continuous flexible sheet 36 of polypropylene foam. However, any material having the desired insulative properties may be utilized. The foam sheet 36 is applied to the lower side 24 of the bag and with either end extending about the ends 38 and 40 of the bag 12 and over the upper side 22 of the bag towards the flap 26. The insulating sheet 36 may be secured to bag 12 by a suitable adhesive capable of withstanding the elevated temperatures encountered in a microwave oven, or by any other means, such as mechanical clips.

In any of the embodiments of the invention described herein, one or more labels (not shown) may be adhered or attached to the exterior of the microwave food package in one or more locations for advertising, identification, instructional, or other purposes. Alternatively, indicia, logos or the like may be imprinted directly on the outermost layer of the package, including the insulating layer.

In use, the illustrated embodiment of the microwave food package 10 is placed in a microwave oven with the lower side 24 of the bag 12 placed downward. This positions the chamber 18 and the foodstuff 20 therein in a generally horizontal position and the foodstuff having a generally uniform thickness. Upon heating, the build up of vapor pressure in the chamber may lift the upper side of the bag. Since the orifice 30 is located medially on the upper side 22 of the bag, the orifice is lifted and is positioned at a high point of the bag. Thus, when orifice 30 is opened, the foodstuff 20 is prevented by gravity from escaping from the package 10. The horizontal position and generally uniform thickness of the foodstuff 20 in the bag enables the foodstuff to be evenly heated by the microwave oven, without the burning and uneven heating of conventional cup like containers, as previously discussed.

As utilized herein, the term "susceptor" refers to substrates which include a layer of microwave interactive material capable of absorbing microwave energy and converting the microwave energy to sensible heat.

As utilized herein, the term "microwave interactive" refers to materials which absorb and/or reflect a substantial proportion of the microwave energy striking the material.

As utilized herein, the term "microwave shield" refers to microwave reflective materials which can be configured about a food item so as to reduce the amount of microwave energy directly transmitted to the food item.

As utilized herein, the term "microwave transparent" refers to materials which allow microwaves to be transmitted therethrough without a substantial alteration in the intensity or direction of the microwaves.

Figure 6:
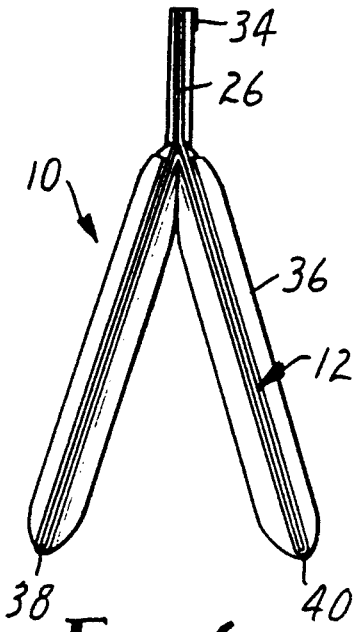
FIG. 6 is a side view of the microwave food package of FIG. 5 after heating in microwave oven and with the package folded about a transverse line on the lower side thereof.
Figure 5:
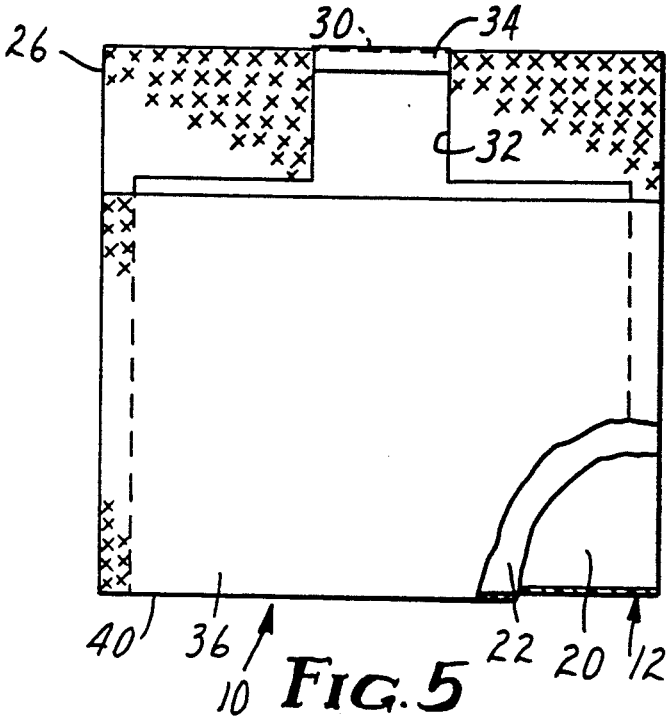
FIG. 5 is a plan view of the microwave food package of FIG. 1, partially broken away.
Figure 7:
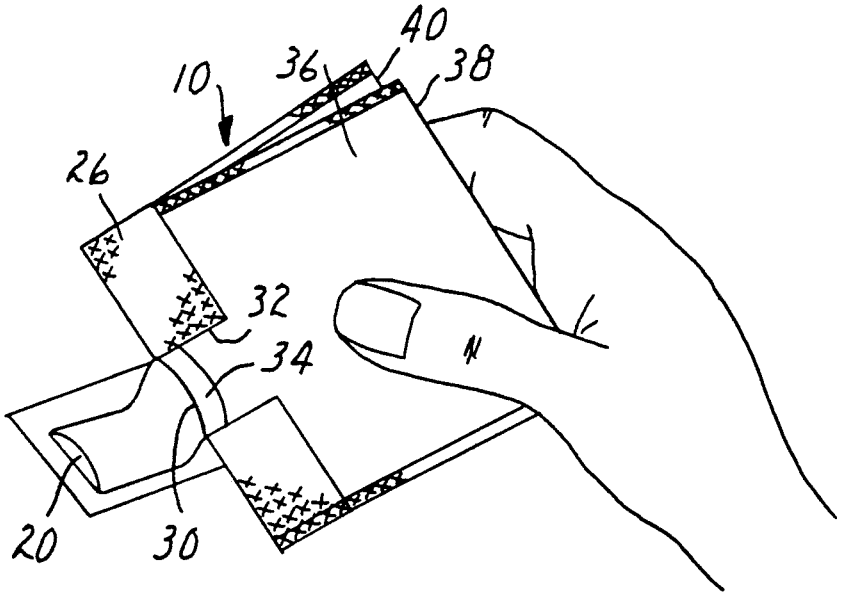
FIG. 7 is an isometric view of the foodstuff of the microwave food package of FIG. 1 being dispensed after heating in microwave oven.

FIGS. 5 and 6 illustrate the configuration of the package after heating and removal from a microwave oven. Since orifice 30 has been opened, the preferred method for dispensing the foodstuff is to fold the bag 12 and the chamber 18 about a transverse line on the lower side 24 of the bag aligned with the flap 26. The folded chamber 18 may then be squeezed, as shown in FIG. 7, to force the foodstuff 20 to flow from the chamber and through the orifice 30. The package 10 may then be discarded. This enables substantially all of the foodstuff to be heated and dispensed from the package without the use of a utensil.

Although the venting member 34 is illustrated as mounted at or near the distal end of the passageway 32, it is within the spirit and scope of this invention to mount the venting member 34 at any location along the length of the passageway, such as the end proximate the chamber 18. In such a case, other means, such as the tear strips, perforated or weakened lines or the like previously described herein, may be employed to open the distal end of the passageway to dispense the foodstuff.

In one example of a microwave food package according to the present invention, a sheet was constructed by laminating the PVDC side of a 0.00052 inch (0.013 mm) thick support layer of Scotchpar TM 2708 brand film available from Minnesota Mining and Manufacturing Company of St. Paul, Minn. to a 0.001 inch (0.025 mm) thick heat sealing layer of CP136 polypropylene film available from the Crown Advanced Film Division of James River Corp. of Orange, Tex. with Adcote 76T198 adhesive available from Morton Thiokol of Chicago, Ill. (dry weight of 2–3 pounds per 3,000 square feet of film). An insulating layer of 0.0625 inch (1.59 mm) thick polypropylene foam available from Ametek, Inc. of Chadds Ford, Pa. under the trade mark "Microfoam" was laminated to the exterior of the film previously described when formed into a bag as shown in FIG. 1, with a Swift No. 48803 brand pressure sensitive adhesive available from the Swift Adhesives Division of Reichhold Chemicals, Inc. of Downer's Grove, Ill. to the outside (polyester) of the bag film. A 0.00057 inch (0.014 mm) thick layer of Scotchpar TM 86096 brand film may be substituted for the Scotchpar TM 2708 brand film.

In an alternative arrangement, separate insulating sheets (not shown) may be applied to the upper side of the bag on either side of the flap. In such an arrangement, the bag 12 may be removed from a microwave oven by grasping the flap 26 and lifting the bag so that the bag is automatically folded over on itself about a transverse line on the lower side 24 generally opposite the flap (as shown in FIG. 6). This places the insulating sheets on opposite sides of the exposed surfaces of the bag. The bag may then be grasped by the insulating sheets and squeezed to dispense the foodstuff.

Figure 8:
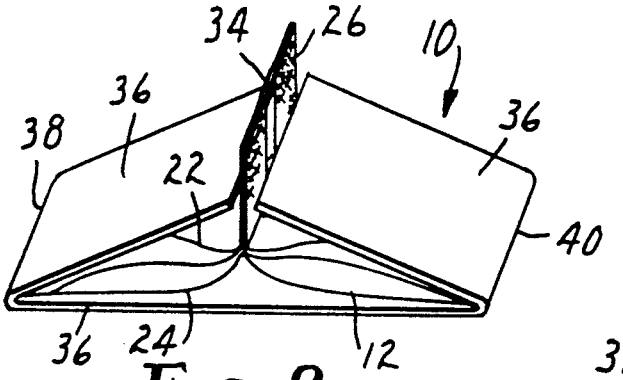
FIG. 8 is an isometric view of an alternate embodiment of the microwave food package of this invention.
Figure 9:
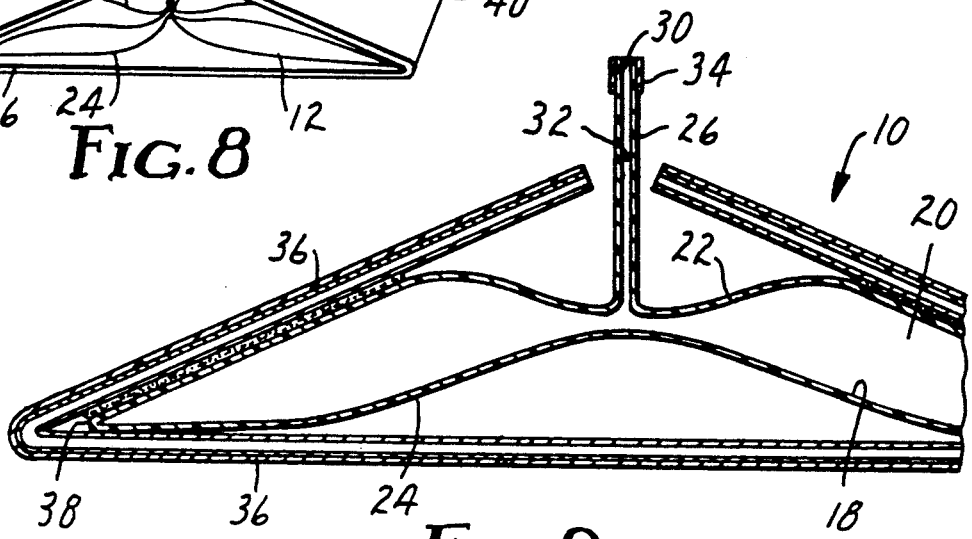
FIG. 9 is side view of the microwave food package of FIG. 8.
Figure 10:
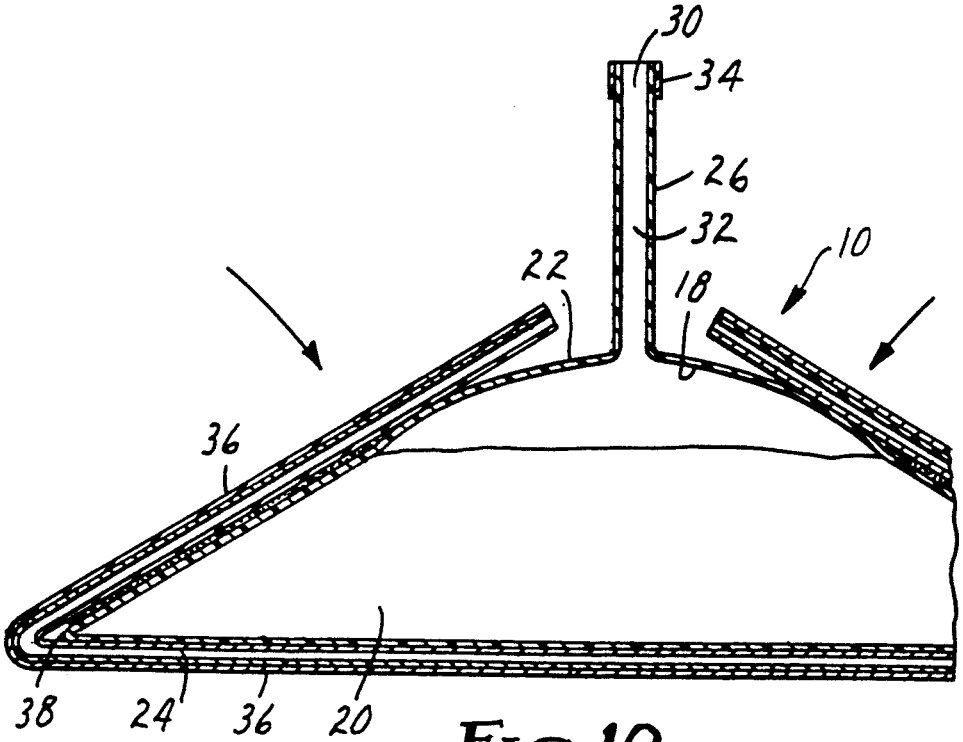
FIG. 10 is a side view of the microwave food package of FIG. 9 after the foodstuff has been heated in a microwave oven and the orifice has been opened.
Figure 11:
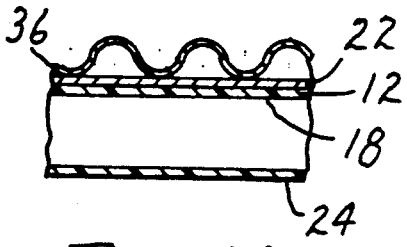
FIG. 11 is a magnified partial view of the stiffening sheet of FIG. 10
Figure 12:
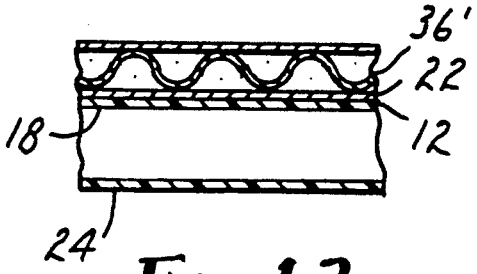
FIG. 12 is a magnified partial view of an alternate embodiment of the stiffening sheet of FIG. 11.

FIGS. 8–10 illustrate an alternate embodiment of this invention in which the insulating sheet 36 also takes the form of a stiffening sheet. The stiffening sheet 36 provides sufficient stiffness to the bag to assist in the squeezing of the chamber during dispensing of the foodstuff. In the illustrated embodiment, the insulating sheet takes the form of a sheet of single faced corrugated chipboard, with the corrugations facing outwardly. The sheet is bent and flexible at the ends 38, 40 of the bag 12 so that the portions on the upper side 22 of the bag are hingedly connected to the portion on the lower side of the bag. Dispensing of the foodstuff is assisted by pushing the portions of the sheet 36 on the upper side of the bag towards the portion of the sheet 36 on the lower side of the bag. In this embodiment, the chamber 18 is not folded over on itself in the manner shown in FIG. 6. Of course, if desired, a stiffening sheet may be provided separate from the insulating sheet and mounted on the package either above or below the insulating sheet. The corrugations of the single faced stiffening sheet should preferably either be directed outwardly (as in FIG. 11) or the stiffening sheet should be double faced (as in FIG. 12).

Figure 13:
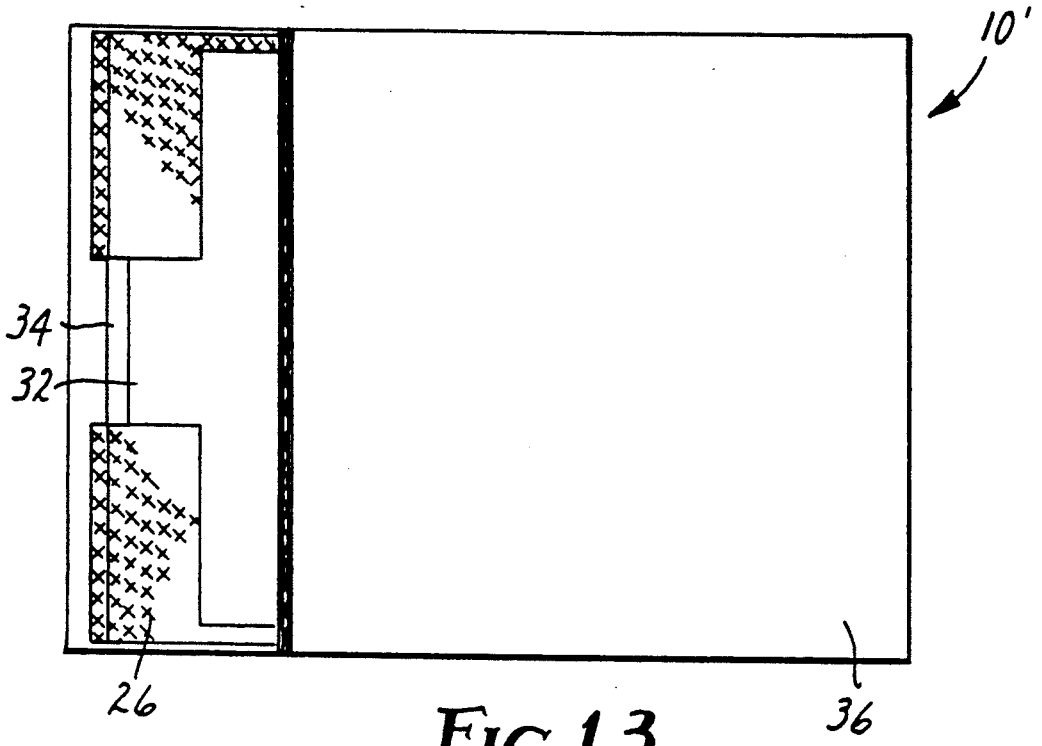
FIG. 13 is a plan view of yet another alternate embodiment of the microwave food package of this invention.
Figure 14:
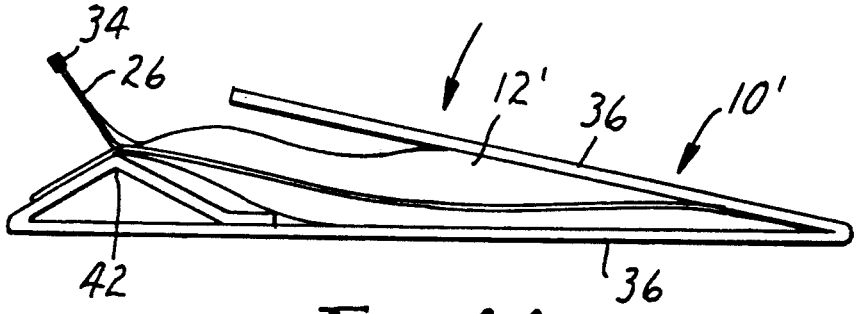
FIG. 14 is a side view of the microwave food package of FIG. 13.

FIGS. 13 and 14 illustrate an embodiment 10' of the invention in which the orifice 30 and venting member 34 are located at one end of the bag 12', with the orifice communicating with the chamber 18. An insulating and stiffening sheet 36' is provided that includes ridge 42 to support the bag in a recumbent (although still generally horizontal within the meaning of this invention) position, but with the end 38' of the bag having the orifice 30 tilted slightly upwards, to prevent the escape of foodstuff from the bag after the venting member 34 is ruptured. The portion of the insulating and stiffening sheet 36' that is on the upper side 22 of the bag 12 may be pushed towards the portion of the sheet 36' on the lower side 24 of the bag to squeeze the chamber and dispense the foodstuff through the orifice.

Figure 15:
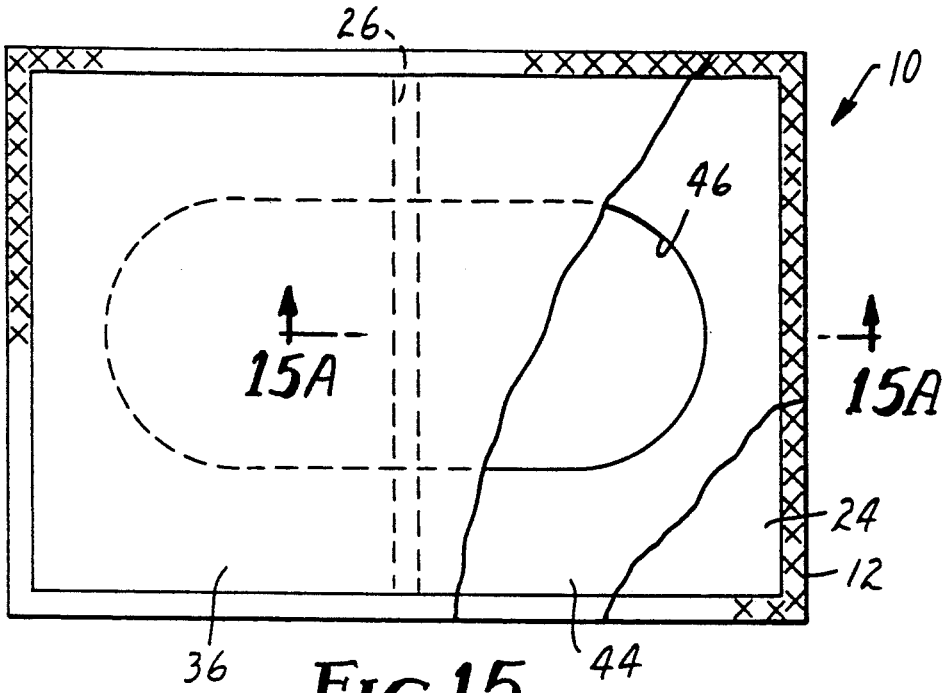
FIG. 15 is a bottom view of yet another alternate embodiment of the microwave food package of this invention having a microwave shielding member.

FIGS. 15 and **15*a* illustrate another embodiment 10' of the invention in which a microwave shielding member or layer 44 is applied to the lower side 24 of a bag 12 as shown in FIG. 1. The microwave shielding member 44 may be constructed from any suitable microwave shielding material, such as thin metal foils, which may attenuate the microwave radiation directed at the package, or the microwave shield be completely opaque to microwave radiation. In any case, the shield facilities uniform heating of the foodstuff thought the chamber by reducing the rate of heating at the edges thereof relative to the middle of the bag. In the illustrated embodiment, shield 44 is constructed from 0.0003 inch (0.0076 mm) thick layer of aluminum foil laminated to a supporting paper substrate and the laminate adhered to the bag with a Swift brand 48803 adhesive. The paper substrate provides mechanical support to the relatively thin and weak metal foil during handling and application to the package. If the foil is cracked or severely wrinkled, arcing may occur during heating of the foodstuff in a microwave oven. As illustrated, the shield includes a central opening 46**. Alternatively, thicker metal foils may be employed, such as 0.003 inch ( 0.076 mm) Aluminum foil.

In conjunction with the flat chamber of generally uniform thickness, the shield 44 acts to prevent the edges of the foodstuff from exposure to excessive amounts of microwave energy while enabling unimpeded heating of the foodstuff in the middle of the bag. Of course, the size, shape, thickness, location, and number of the shields may be varied as is found effective for a particular application.

The following are three comparative examples of microwave food packages according to the present invention to demonstrate the effect of the shielding layer 44 on the uniform heating of the foodstuff:

COMPARATIVE EXAMPLE 1 WITHOUT SHIELDING

A pouch was made by heat sealing 4"×6" (102 mm ×152 mm) films made of Scotchpak TM Type 5 with the polyethylene sides together as shown in FIGS. 1-7. Scotchpak #5 film is 0.002 inch thick (0.051 mm) and is made of a layer of polyester and a layer of polyethylene. The pouch was heat sealed about 0.5 inch (1.2 mm) around the bottom and two of the sides and about 1.5 inch (3.8 mm) on the top to form a chamber that is 3"×4.5" (76 mm ×108 mm). Four (4) ounces (113 grams) of Cheese Whiz brand processed cheese (available from Kraft, Inc. of Glenview, Ill.) was placed in the chamber just prior to sealing the top edge.

The top (as the pouch lays flat) of the filled pouch was slit in the center with a razor blade to form a 0.5" (13 mm) long slit to allow steam to escape. The pouch was then heated in a 600 watt microwave oven at full power for 45 seconds, after which the temperature of the Cheez Whiz was measured with a Fluke 52 K/J (Type J) thermocouple available from John Fluke Manufacturing Co., Inc. of Rolling Meadows, Ill. at the four corners of the pouch and in the center of the pouch. The sample was then heated in the 600 watt microwave oven at full power for another 45 seconds and the temperature was again measured at the corners and center as described above. Results are noted in Table 1. No shielding was used.

EXAMPLE 2 WITH SHIELDING

A second pouch was made and filled as described above. A shielding material consisting of a composite made of 0.0003 inch (0.0076 mm) aluminum foil laminated to 20 lb. bleached Kraft paper was cut into a 3.25"×4.75" (83 mm ×121 mm) rectangle and laminated to the pouch with the paper side to the pouch with a Swift #48803 brand adhesive. The composite is available as described from Reynolds Metals Co. of Richmond, Va. The filled pouch was heated and temperature was measured as described above. The results are recorded in Table 1. (The slit was made as in Example 1 and the shield was on the bottom of the pouch as in FIG. 15.)

EXAMPLE 2 WITH PARTIAL SHIELDING

A third pouch was made and filled as described in Example 1. The shielding material of Example 2 was used except that an oval hole 1.75"×3.25" (45 mm ×83 mm) was cut about in the middle of the shielding material. The filled pouch was heated and the temperature was measured at 45 seconds and at 90 seconds as described in Example 1. Results are recorded in Table 1. (A slit was made as in Example 1 and the Shield was on the bottom of the pouch.)

TABLE 1

| Configuration | Time Sec. | Center Temp. Deg. F. | Center Temp. Deg. C. | Average Corner Temp. Deg. F. | Average Corner Temp. Deg. C. |
|---|---|---|---|---|---|
| No Shield | 45 | 140 | 60 | 183 | 84 |
| (Ex. 1) | 90 | 170 | 77 | 204 | 96 |
| Full Bottom | 45 | 97 | 36 | 137 | 58 |
| Shield (Ex. 2) | 90 | 105 | 41 | 165 | 74 |
| Part Bottom | 45 | 105 | 41 | 125 | 52 |
| Shield (Ex. 3) | 90 | 160 | 71 | 159 | 71 |

Example's 2 and 3 show that the shield layer prevents the corner temperature of the foodstuff from getting too high and causing burning. Example 3 shows uniform heating of the foodstuff from edge to center.

Figure 16:
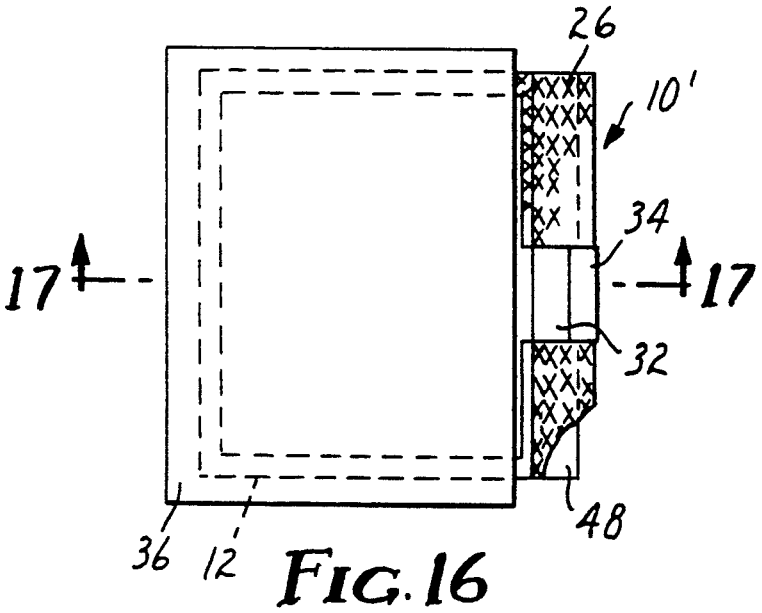
FIG. 16 is a plan view, partially broken away, of another alternate embodiment of the microwave food package of this invention.
Figure 17:
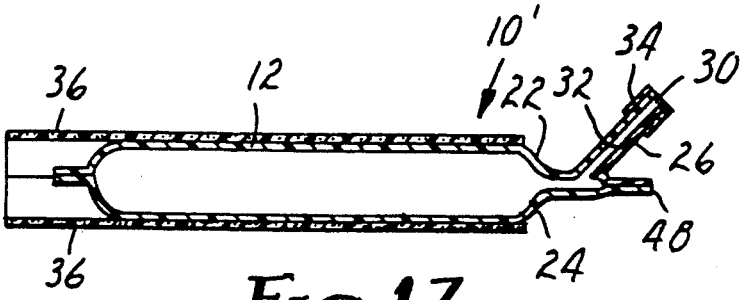
FIG. 17 is a cross sectional view along plane 17—17 of the microwave food package of FIG. 16.

FIGS. 16 and 17 illustrate an embodiment of 10' the invention similar to that shown in FIGS. 13 and 14, but wherein the insulating sheet 36' comprises a sheet of foam, without significant stiffening properties. Further, one side of the flap 26 is provided with an auxiliary flap 48 on the same side as the lower side 24. When placed horizontally in a microwave oven, the auxiliary flap 48 urges the flap 26 into a generally upright position as shown. In this manner, the foodstuff is prevented from spilling or "percolating" through the orifice 30 during heating of the foodstuff and after rupturing caused by venting member 34.

Figure 18:
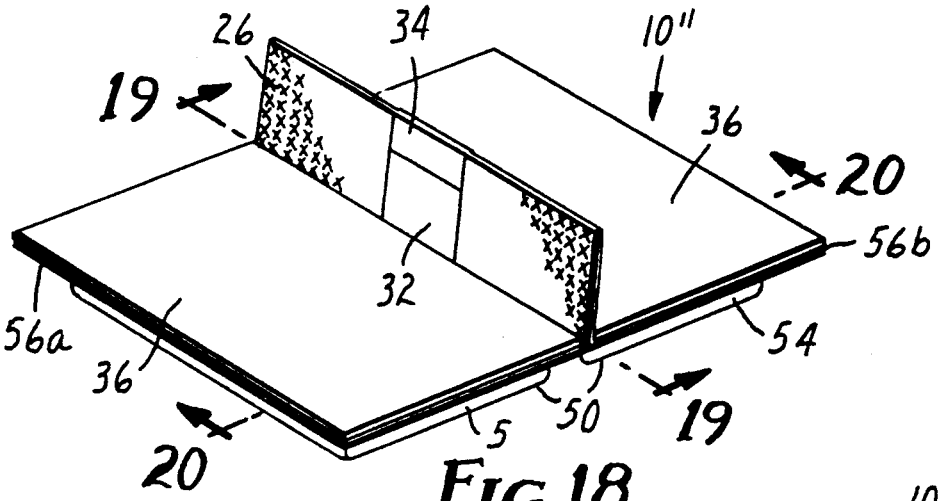
FIG. 18 is an isometric view of another alternate embodiment of the microwave food package of this invention.
Figure 19:
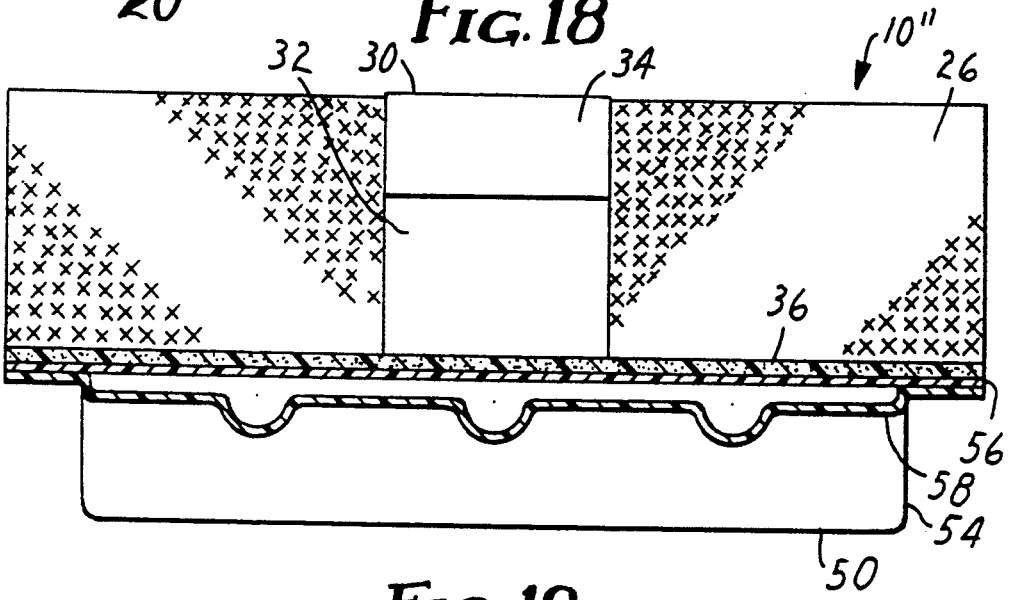
FIG. 19 is a transverse cross sectional view along plane 19—19 of the microwave food package of FIG. 18.
Figure 20:
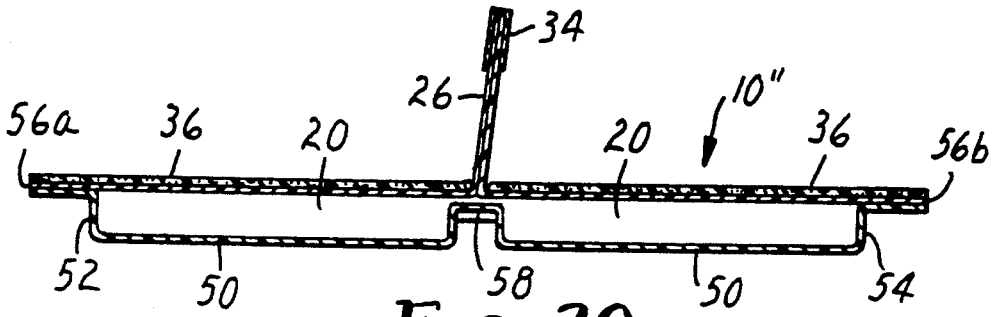
FIG. 20 is a longitudinal cross sectional view along plane 20—20 of the microwave food package of FIG. 18.
Figure 21:
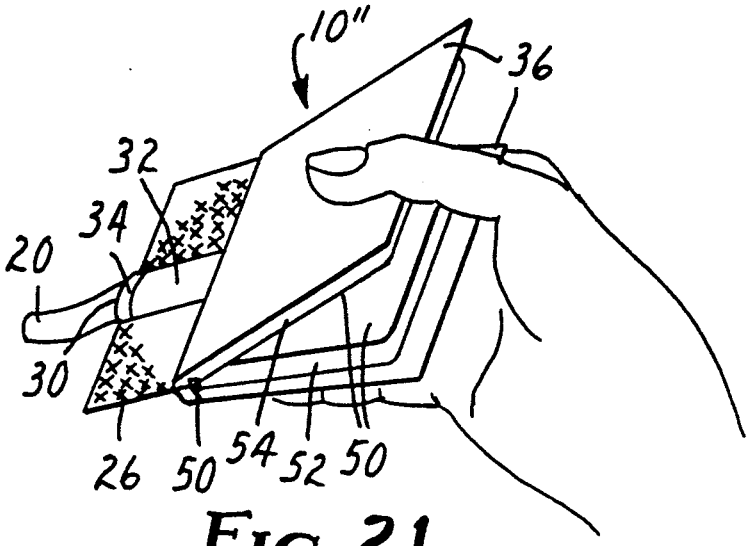
FIG. 21 is an isometric view of the microwave food package of FIG. 18 with the foodstuff being dispensed.
Figure 22:
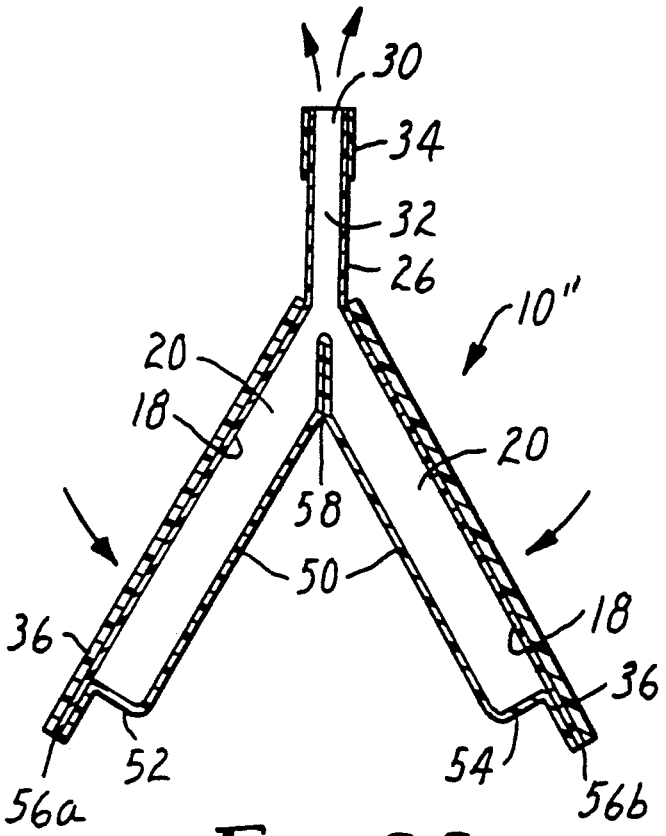
FIG. 22 is a side view of the microwave food package of FIG. 18 folded about a transverse line on the lower side aligned with the dispensing orifice.

FIGS. 18-20 illustrate an embodiment 10" of the invention which includes a tray portion 50. The tray portion may be formed such as by vacuum forming, blow molding, injection molding, embossing, cold forming, or by any other suitable method. A film 56 is laminated or sealed to the tray portion 50 to form the enclosed chamber 18 for receipt of the foodstuff 20. Such an arrangement has significant manufacturing advantages for filing the chamber with foodstuff and then sealing the chamber with the film 56. As illustrated, the film 56 comprises two separate sheets **56*a* and 56*b* that are laminated or sealed to the tray portion 50 and to each other at a medial position to form flap 26, with the chamber 50 divided into receptacles 52 and 54 communicating with each other adjacent the flap 26. Venting member 34 and insulating sheets 36' are provided as previously described. The foodstuff 20 may be dispensed as shown in FIGS. 21 and 22 by folding the tray portion 50 over on itself about preformed transverse fold line 58 opposite the flap 26 and squeezing the receptacles 52, 54** together.

An example of a microwave food package 10" constructed according to the embodiment shown in FIGS.

18–20 includes a tray portion constructed of 0.0075 inch (0.19 mm) thick Curlon HK-28 nylon/ionomer film available from Curwood, Inc. of New London, Wis. and a top film constructed of 0.003 inch (0.076 mm) thick Curlon MKS nylon/ionomer film.

The microwave food package of the present invention thus provides an effective container for storage and uniform heating of a foodstuff in a microwave oven, and for efficiently dispensing the foodstuff in a flowable state without use of a utensil, after which the package may be disposed of. The package may be handled and the foodstuff may be dispensed immediately after heating in the microwave oven, or the dispensing of the foodstuff may be delayed while the heated foodstuff is retained in the insulated package.

The present invention has now been described with reference to several embodiments thereof. It will be apparent to those skilled in the art that many changes can be made in the embodiments described without departing from the scope of the present invention. For instance, this invention further includes the microwave food package as hereinabove described in combination with a quantity of a foodstuff. Further, the microwave food package of this invention may be constructed with a longitudinal or diagonal fold line, or with multiple fold lines or with fold lines located at any desired location on the package and specifically, the fold line does not have to be aligned with the orifice. Similarly, the microwave shielding member may be located on any portion or portions of the package as is found advantageous. The orifice 30 may be located anywhere on the package, and specifically, the orifice may be positioned at any transverse point along the flap 26. The orifice may be constructed with a rigid member of pouring spout to facilitate dispensing the foodstuff, such as a cylindrical tube or nozzle. Finally, the shape of the package and/or the bag 12 may be varied as desired, such as round, triangular, octangonal, cylindrical or the like. Thus, the scope of the present invention should not be limited to the structures described in this application, but only by structures described by the language of the claims and the equivalents of those structures.

What is claimed is:

1. A microwave package for containing a quantity of a product for heating the product in a microwave oven and dispensing the product in a flowable state, comprising:

a flexible bag having a chamber for receiving the product, said flexible bag having opposed ends and an upper side and an opposed lower side for generally horizontal placement of the product within a microwave oven, wherein said flexible bag is constructed from a microwave transparent flexible polymeric film and includes sealed opposed side edges and a flap comprising an overlap of said polymeric film, said flap including a means for providing an orifice between the chamber of said flexible bag and the exterior thereof for dispensing the product in a flowable state from within the chamber after heating in a microwave oven, and a flexible insulating layer covering at least a portion of said bag enabling handling of said bag after heating of the product in a microwave oven, said flexible insulating layer comprising a flexible layer of polymeric foam material, wherein the product can be dispensed through said means for providing an orifice by squeezing said flexible bag at said flexible insulating layer.

2. The microwave package of claim 1, wherein said means for providing an orifice in said bag includes an orifice preformed in said bag and including means for enclosing said orifice prior to heating the product in the microwave oven and for opening said orifice for dispensing the product in a flowable state.

3. The microwave package of claim 2 wherein said means for providing an orifice after heating of the product includes a means for venting said chamber.

4. The microwave package of claim 3, wherein said venting means comprises a venting member comprising microwave susceptor material mounted on said bag adjacent said chamber.

5. The microwave package of claim 1, wherein said orifice is medially located along said side of said bag and wherein said chamber may be folded about a transverse line on said lower side of said bag aligned with said orifice and the folded portions of said chamber squeezed to dispense the product from said chamber through said orifice.

6. The microwave package of claim 1, wherein said chamber is formed from a flexible polymeric film folded over and facing surfaces of said upper side and said lower side sealed to each other.

7. The microwave package of claim 1, wherein said orifice further includes a pouring spout communicating with said chamber for dispensing the product.

8. The microwave package of claim 1, further including stiffening sheets wherein said stiffening sheets may be squeezed together to dispense the product from said chamber.

9. The microwave package of claim 1, wherein said orifice is medially located along said upper side and further including a stiffening sheet mounted adjacent said lower side and at least one stiffening sheet mounted on said upper side, whereby said stiffening sheets may be squeezed together to dispense the product through said orifice.

10. The microwave package of claim 1, wherein said orifice is adjacent one of said ends of said bag.

11. The microwave package of claim 10, further including means for holding said bag in a recumbent position with said orifice being located at a raised end of said bag.

12. The microwave package of claim 1, wherein said bag includes a tray portion forming said lower side of said bag and a film sealed to said tray portion to form said chamber and said upper side of said bag, wherein said tray portion includes a transverse fold line aligned with said orifice.

13. The microwave package of claim 1, further including a microwave shielding layer mounted, on said bag for selectively shielding portions of said product within said chamber from microwave energy to facilitate uniform heating of the product throughout the package.

14. The microwave package of claim 13, wherein said microwave shielding layer is applied to said lower side of said bag.

15. The microwave package of claim 1, wherein said flexible polymeric film is a heat sealable film and forms the interior layer of said bag.

16. The microwave package of claim 1, wherein said polymeric foam layer forms the exterior layer of said bag.

17. The microwave package of claim 1, wherein said means for forming an orifice through said flap comprises a spout formed within said flap by partially sealing facing surfaces of said flexible polymeric film together at said overlap, so that when said spout is opened, the product can be dispensed from said bag in a flowable state through said spout.

18. A package for containing a quantity of a product and dispensing the product in a flowable state, comprising:

a flexible bag having a chamber for receiving the product, said flexible bag having opposed ends and an upper side and an opposed lower side for generally horizontal placement of the product within said flexible bag, said flexible bag is constructed from a flexible layer of material and includes sealed opposed side edges and a flap comprising an overlap of said flexible material, wherein facing surfaces of said flexible material are partially sealed together at said overlap of said flexible material so as to define a spout within said flap, which, when opened, permits controlled dispensing of the product in a flowable state from the chamber of said flexible bag to the exterior thereof.

19. The package of claim 18, further including an insulating layer covering at least a portion of said bag, said insulating layer comprising a layer of polymeric foam material.

20. A package for containing a quantity of a product and dispensing the product in a flowable state, said package having a product storage state and a dispensing state, said package comprising:

a flexible bag having a chamber for receiving the product, said flexible bag having opposed ends and an upper side and an opposed lower side for generally horizontal placement of the product, wherein said flexible bag is constructed from a flexible material and includes sealed opposed side edges and a flap on said upper side comprising an overlap of said flexible material, said flap including a means for providing an orifice between the chamber of said flexible bag and the exterior thereof for dispensing the product from within the chamber in a flowable state, and said lower side of said bag is provided with a fold line substantially opposed to the position of said flap on said upper side of said bag, wherein, in said storage state, said lower side of said bag is substantially flat with said fold line substantially unfolded and said means for providing an orifice between said chamber and the exterior of said bag closed, and in said dispensing state, said means for providing an orifice between the chamber of said flexible bag and the exterior of said bag is opened and said lower side is folded at said fold line which effectively divides said bag into two wing portions, each wing portion comprising a portion of said upper side divided from one another by said flap and a portion of said lower side divided by said fold line, so that when said wing portions are urged against one another while in said dispensing state, the product is dispensed from within said chamber through said means for providing an orifice.

* * * * *

UNITED STATES PATENT AND TRADEMARK OFFICE

CERTIFICATE OF CORRECTION

PATENT NO. : 5,241,150

DATED : Aug. 31, 1993

INVENTOR(S) : Garvey et al.

It is certified that error appears in the above-indentified patent and that said Letters Patent is hereby corrected as shown below:

In claim 5, column 12, line 15,

"along said side of said bag" should be --along said upper side of said bag--.

Signed and Sealed this

Twenty-seventh Day of June, 1995

Bruce Lehman

*Attest:*

BRUCE LEHMAN

*Attesting Officer*

*Commissioner of Patents and Trademarks*